US005791990A

United States Patent [19]

Schroeder et al.

[11] Patent Number: 5,791,990

[45] Date of Patent: Aug. 11, 1998

[54] LOTTERY SYSTEM

[75] Inventors: J. Michael Schroeder; Mark Klingler, both of Boise, Id.; Deborah G. Davidson, Gainesville; Fred W. Finnerty, Dawsonville, both of Ga.

[73] Assignee: Dittler Brothers Incorporated, Atlanta, Ga.

[21] Appl. No.: 753,953

[22] Filed: Dec. 3, 1996

[51] Int. Cl.[6] ..... A63F 3/06

[52] U.S. Cl. ..... 463/17; 273/138.2; 273/139; 283/901; 283/903

[58] Field of Search ..... 463/17, 18; 273/139, 273/138.2; 283/901, 903

[56] References Cited

U.S. PATENT DOCUMENTS

| | | | |
|---|---|---|---|
| 5,231,568 | 7/1993 | Cohen et al. | 463/17 |
| 5,346,258 | 9/1994 | Behm et al. | 283/102 |
| 5,377,975 | 1/1995 | Clapper, Jr. | 463/17 |
| 5,532,046 | 7/1996 | Rich et al. | 428/202 |
| 5,569,082 | 10/1996 | Kaye | 463/17 |
| 5,569,512 | 10/1996 | Brawner et al. | 428/29 |
| 5,628,684 | 5/1997 | Bouedec | 463/17 |

*Primary Examiner*—Benjamin H. Layno

*Attorney, Agent, or Firm*—Dean W. Russell; Kilpatrick Stockton LLP

[57] ABSTRACT

Interactive, computer-activated games or other activities are disclosed. Included among the disclosed embodiments are systems employing not only a computer program, but also a ticket that, if a "winner," must be modified prior to redemption to include information gleaned by executing the program. The ticket additionally may include an activation code for input into the computer program.

17 Claims, 5 Drawing Sheets

LOTTERY SYSTEM

FIELD OF THE INVENTION

This invention relates to a system for lotteries, gaming, or promotional games and to its components, including tickets and associated computer software. More particularly, the invention relates to a computer-activated game, some versions of which have an associated ticket for validation and redemption purposes.

BACKGROUND OF THE INVENTION

Governmental lotteries and analogous private gaming activities have become increasingly popular in many areas of the United States and of the world. Similar games and contests are often used by private industrial companies for promotional purposes. Particularly favored in these contexts are so-called "instant-win" tickets, in which an opaque latex covering obscures symbols or indicia. To play the game presented on such a ticket, a player removes ("scratches off") the latex covering to reveal the hidden symbols. By doing so, the player is able to discern whether he or she has won a prize associated with the game played on the ticket.

U.S. Pat. Nos. 5,532,046 to Rich, et al. and 5,569,512 to Brawner, et al., each incorporated herein in its entirety by this reference, describe structures of various instant-win tickets. As disclosed in the Rich, et al. patent, for example, foil or coatings including metallic particles may be used in the tickets to deter candling, a process whereby unscrupulous players attempt to view the hidden symbols by examining the tickets before a light source. The Brawner, et al. patent, by contrast, discusses masking the boundaries of the scratch-off covering on a ticket to make them more difficult to locate and thereby inhibit improper removal of the covering. U.S. Pat. No. 5,346,258 to Behm, et al., furthermore, references use of a benday pattern interposed between the substrate and hidden symbols of an instant-win ticket. According to the Behm, et al. patent, the purpose of the benday pattern is to facilitate detection of vertical ticket splitting. Because the benday patterns of any two selected tickets are reasonably likely to differ, removing a portion of the play area of one card and transferring it to another will probably cause visible discontinuities to appear in the resulting merged pattern.

Among the advantages of instant-win tickets are their ability to provide immediate gratification to the player. Unlike holders of tickets for scheduled prize drawings, for example, who must await completion of the drawings to determine whether they have won any prize, purchasers of instant-win tickets are able to discern the extent of their successful play immediately following their acquiring the tickets. However, empirical evidence suggests that some purchasers prefer greater involvement with the games presented on the tickets than many instant-win tickets typically provide. As a consequence, more recently created have been "extended" and "additional" play tickets, whose games are either multiple in number or not limited to removing a single opaque covering.

Although these extended and additional play tickets are useful for their intended purposes, the time in which their games are played remains of modest length. This limited play time is, to some extent, a function of the small size of instant-win tickets generally, which restricts the amount of game-related information capable of being printed on the tickets. By contrast, magnetic memory devices associated with existing personal computers are adapted to store quantities of information greater by many orders of magnitude.

Thus, by transferring game-related information from the instant-win tickets to magnetic memory devices, more complex and longer playing games may be developed.

Until recently, applicants were unaware of any effort (other than their own) to link so-called instant-win tickets with the personal computers of those who purchase the tickets. However, a 1996 brochure of Gizmo Enterprises, Inc. entitled "Interactive Multimedia Lottery Ticket" touts something called "WinWare," and states "Patent Pending in 85 Countries." According to the brochure, "WinWare" is "an improved lottery ticket that increases the excitement of lottery play." Players purportedly > purchase WinWare® tickets from . . . existing retailers, then use their home computer or a retail WinWare® gaming system to play interactive Lottery games. There is no skill involved because the outcome of the game is controlled by the ticket. . . . When players win they simply bring their tickets back to |a| retailer and collect the prize.

(Emphasis omitted.)

Samples of "WinWare" tickets include on their faces at least one six-character set of symbols together with artwork and information concerning the price of the ticket (e.g. "Price $1") and a potential prize value (e.g. "Win $10,000"). The tickets appear not to contain any structural security features, and their reverses are blank. To determine whether a particular ticket is a winning one, the purchaser apparently merely loads a computer program onto his or her home computer, enters one of the six-character symbol sets when prompted by the program, and if willing plays the game provided by the program. The program purportedly then informs the purchaser whether the six-character symbol set represents a winning combination.

As described in the brochure for "WinWare," the tickets are "game independent" and can "be used to play any of the offered games" at the "player's choice." Accordingly, the six-character symbol set is both the sole determinant of whether the player has won a prize and the sole feature of the ticket that permits validation by the entity funding the prize. In other words, the game need never be played; the purchaser instead need merely ask the retailer to attempt to validate each six-character set of symbols on the face of the ticket, with those that validate being winning combinations. In this sense the "WinWare" tickets are not "interactive" at all, but rather serve merely as substrates onto which either winning or losing character sets are pre-printed.

Moreover, because the tickets are "game independent," each computer program must contain information concerning the character sets that present winning combinations in the event the purchaser elects to determine whether he or she has won a prize by actually playing the game provided by the program. For example, if a ticket contains the character sets "7243BA," "J4DTA1," and "K6IIN2," each computer program associated with the "WinWare" system must be able to discern whether each of these sets represents a winning combination. Otherwise, after playing any of the available games, a purchaser would be unable to learn whether the input character set constitutes a prize winner.

The lack of security features believed to be present in the system increases the possibility of fraudulent redemption of "WinWare" tickets. In particular, because the tickets are generic substrates, they may readily be duplicated by purchasers; if any so-duplicated ticket contains a winning set of characters, the entire prize structure of the lottery or other gaming activity may be undermined. Furthermore, once a purchaser learns that a particular six-character set of symbols represents a winning combination, by disseminating that set alone he or she can provide numerous others an absolute opportunity to defeat the lottery. After learning of a winning character set, an unscrupulous player need merely purchase a single ticket (containing any symbol set) and use existing tampering techniques to modify the symbol set to that of the winning combination.

SUMMARY OF THE INVENTION

The present invention, by contrast, provides a lottery, gaming, or promotional system which is both interactive and more secure than that described in the "WinWare" brochure. Some embodiments of the invention include not only a computer program, but also a ticket that, if a "winner," must be modified prior to redemption to include information gleaned only by executing the program. Such ticket may be structured so as to incorporate mechanisms for reducing the possibility of tampering and, in certain versions of the invention, includes an opaque, removable ("scratch-off") coating. Tickets used as part of the invention may also include an activation code for input into the computer program.

For example, certain versions of the invention contemplate a player purchasing from a retail outlet a package containing a magnetic medium (e.g. a floppy or compact disc) and a ticket or card. Included on either the ticket or disc is the activation code; the disc additionally may include a set of symbols uniquely identifying either the game (or games) stored on the disc or, in some cases, the disc itself. Further included on some tickets may be a machine-readable (e.g. bar) code and either or both of a "book" number and a (unique) ticket number to assist in the validation process. In some embodiments of the invention, the player must remove the scratch-off coating on the ticket to reveal the activation code.

After executing the computer program, the purchaser (manually or electronically) enters into it the activation code when prompted to do so. From this point the purchaser plays a game resident on the disc, thereby having the opportunity to enjoy the entertainment provided by the game. When the game is complete, the program prompts the purchaser to record on the ticket a set of symbols constituting a redemption code. Such recordation may occur through writing the redemption code in an appropriate space on the ticket, removing selected portions of a scratch-off coating present on the ticket, or in any other suitable manner.

Although game play is required for some embodiments of the invention, it need not determine the redemption code if desired. For example, for a "skill" or "probability" game, the likelihood of ultimately having a winning ticket, and therefore of receiving a particular redemption code, depends on one or both of (1) the player's performance and (2) random occurrences during the game. By contrast, in a "pseudo-probability" game, the redemption code is not dependent on the manner in which the game is played. Including these types of games with the tickets can be beneficial in many circumstances, as purchasers appear to be controlling the outcomes but yet are not, reducing the risk to the entity funding the games that only skilled players will purchase the tickets. Embodiments of the invention contemplate providing pseudo-probability games, with the redemption code algorithmically linked to the activation code. Moreover, if the redemption code is fixed in this manner for a particular game and ticket, those purchasers having knowledge of this fact and desiring not to play the game for its entertainment value may simply default at each decision point and complete the game play quickly.

Redemption can be accomplished in some versions of the system by returning the ticket (as modified) to the retailer from which it was purchased. Determination that the ticket holder is entitled to prize money can be made using any or all of the redemption code, the activation code, the machine-readable code pre-printed on the ticket, and any symbols printed on the disc purchased with the ticket. It can, moreover, be made without the player knowing in advance that he or she is entitled to prize winnings. Withholding this information until a redemption attempt is made may be useful in situations where players otherwise would be tempted to play the computer games repeatedly if their initial attempts did not result in success.

Alternatively, if the game itself does not inform the player that winnings are forthcoming at the time it supplies the redemption code, such information can be provided if correct portions of the scratch-off coating on the ticket are removed. For example, various codes could be printed on the ticket, one of which matches the redemption code provided by the game and each of which has a scratch-off area associated with it. In this example removing the scratch-off coating in the area associated with the redemption code could reveal a message (e.g. "You've won $10!") informing the player of the winnings. If part of a probability game, the ticket could be void if the scratch-off coating is removed in more than one area.

Although directed primarily to use of computer programs—and home computers—with tickets, the invention is not necessarily limited in this fashion. Those skilled in the art will recognize that other equipment or media may be used instead. Point-of-sale or other terminals can substitute for home computers, for example, as can hand-held computers and other microcomputer-based devices. Networked versions of the system (including via the Internet) are also within the scope of the invention.

It is therefore an object of the present invention to provide a system in which computer programs are used in connection with playing lotteries or promotional or other games.

It is another object of the present invention to provide a system in which both computer programs and printed substrates such as tickets are used for lotteries, gaming, or promotional activities.

It is also an object of the present invention to provide a system in which information from a ticket or card is used to activate a computer program.

It is a further object of the present invention to provide a system in which information from a computer program is used to modify a ticket or card.

It is an additional object of the present invention to provide a system combining instant-win tickets and magnetic storage media to promote extended involvement of purchasers of the tickets in the games or other activities associated therewith.

It is yet another object of the present invention to provide pseudo-probability and other extended-play lotteries and promotional games.

It is additionally an object of the present invention to provide a system in which a code is included on a ticket and used to activate the computer program and in which the computer program supplies a redemption code algorithmically linked to the activation code.

It is an object of the present invention to provide a system in which redemption of a winning ticket depends, at least in part, on prior modification of the ticket to reflect the code supplied by the computer program.

Other objects, features, and advantages of the present invention will be apparent to those skilled in the art with reference to the remainder of the text and to the drawings of this application.

DETAILED DESCRIPTION

Figure 1:
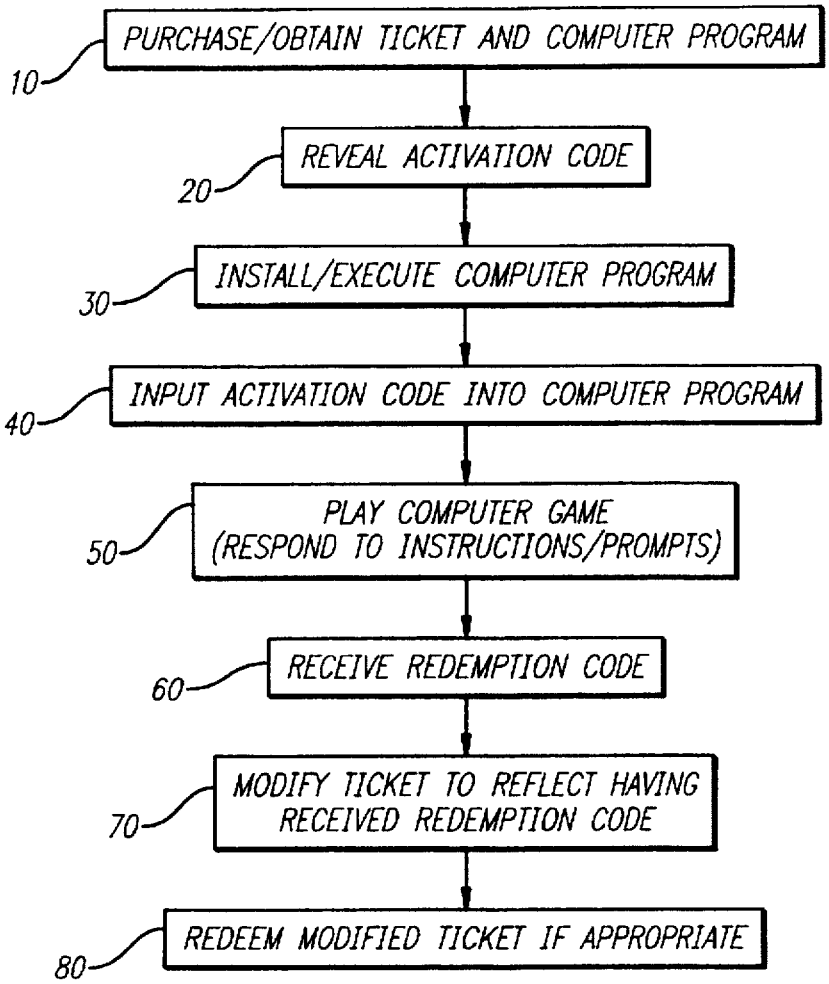
FIG. 1 is a flow chart of player actions to be taken in connection with some embodiments of the present invention.

Detailed in FIG. 1 are actions a player may take when utilizing embodiments of the system of the present invention. As shown in block 10 of FIG. 1, a player initially purchases (or otherwise receives) a ticket or card and a magnetic medium on which a computer program is stored. The card may, although need not necessarily, be similar to any of tickets 15 shown in FIGS. 3–5. Alternatively, it may contain greater or fewer features than tickets 15 and, for example, may omit any game name or other readily-discernable link to a specific computer program.

Typical magnetic media contemplated by the present invention include so-called "floppy" and "compact" discs. Those skilled in the art will recognize that other means of storing a computer program are also within the scope of aspects of the invention and may be used instead of a floppy or compact disc. In particular, some embodiments of the invention permit use of a ticket in connection with a dedicated electronic gaming machine or terminal in which one or more programs may be stored. Moreover, although in many circumstances a ticket will be packaged with a magnetic medium, they need neither be packaged nor provided together. A single disc additionally may contain more than one computer program if appropriate or desired and may be packaged or provided together with any number of cards or tickets.

Either or both of the ticket and magnetic media may contain an activation code. In many preferred embodiments of the invention, each ticket itself contains at least one activation code printed thereon. Often the activation code is covered by an opaque removable (scratch-off) material, making it similar to the hidden play indicia or symbols of conventional lottery tickets. The activation code need not be so covered, however, and may be provided by means other than printing on the ticket or magnetic media.

After obtaining access to the activation code—as by removing the scratch-off coating of a ticket to reveal it per block 20 of FIG. 1—a player may execute a computer program from the magnetic media. Such execution (block 30) may be performed in connection with the player's home computer or any other suitable device and, if appropriate, after the program is installed on the computer. Because designed primarily for their entertainment value, the computer programs may take the form of interactive games. However, other programs may be used instead and remain consistent with the principles of the present invention.

Executing a program results in the player being prompted to supply the activation code (block 40). When using a home computer, this action will typically occur when the player types the code utilizing an associated keyboard. Other methods of supplying the activation code may be used instead, however. For example, the activation code may be contained in machine-readable form on either the ticket or the disc and supplied to the program electronically at the appropriate time. Furthermore, although blocks 20, 30, and 40 illustrate a sequence of actions relating to the activation code and execution of the program, these actions need not necessarily occur in that particular order.

In any event, the player continues by playing the game or otherwise responding to instructions or prompts (block 50), enjoying the entertainment provided thereby. Action and adventure games are especially well-adapted for use as part of the present invention, as they usually provide substantial excitement and multiple levels of play. Of course, other games or endeavors may be employed instead. By contrast with games played on conventional lottery tickets, the computer games playable in connection with the present invention may span significant periods of time. The complexity of games available with the present invention is also greater than those of existing instant-win lottery tickets.

Completion of all or some portion of the program results in the player receiving a redemption code (block 60). The redemption code may be displayed on a monitor associated with the equipment used to execute the program or otherwise provided to the player as appropriate. Preferred embodiments of the invention contemplate the player modifying the appearance of the ticket in response to his or her receipt of the redemption code (block 70), in some cases using a pen to mark it with the symbols comprising the code. Alternatively, the player may remove portions of a scratch-off coating present on the ticket selected as a function of the symbols comprising the redemption code. As yet another alternative, the ticket may be marked automatically by equipment associated with the computer program. Other mechanisms for modifying the appearance of the ticket may be employed instead, however, as necessary or desired. If the redemption code entitles the player to a prize of any sort (or if the player does not know whether he or she is entitled to a prize), the ticket may be redeemed in any conventional manner for the corresponding prize (block 80).

Figure 2:
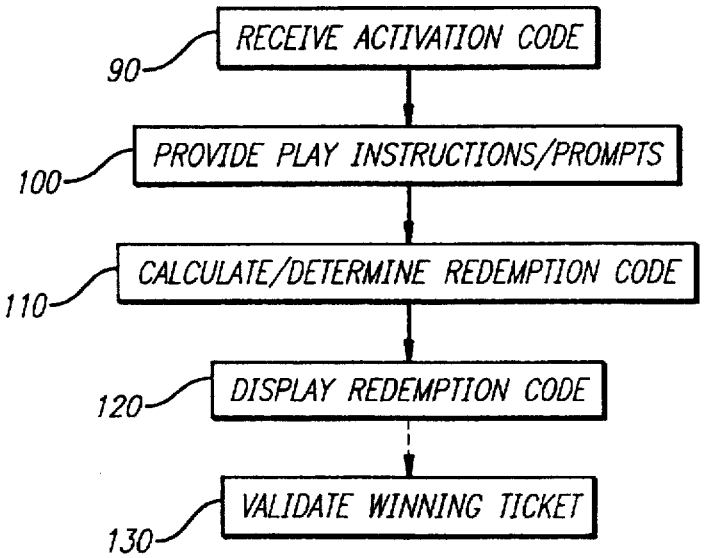
FIG. 2 is a flow chart of other actions to be taken in connection with some embodiments of the present invention.

FIG. 2 illustrates additional actions associated with the present invention. As noted above, the computer program typically receives as input the activation code (block 90) entered either manually by the player or electronically. The program provides play instructions or prompts (or both) permitting the player to enjoy the game or other activity supplied by the program (block 100). Following the player's completion of some or all of the activity, the program determines a redemption code (block 110) for display (block 120), usually on a monitor or on the ticket itself.

In many embodiments of the invention, the redemption code is a series of symbols (often numbers, letters, or combinations of numbers and letters) determined as a function of the activation code. For example the program can, through a series of calculations and formulae, manipulate the symbols of the activation code to produce a different redemption code. Look-up tables may also or alternatively be employed to assign a redemption code to a particular activation code. A unique redemption code need not necessarily be allocated to each different activation code, particularly if the ticket is not a winning one. However, having a one-to-one correspondence between redemption and activation codes for winning tickets may thwart attempts by players to use the same redemption code for multiple tickets.

A retailer or other entity to which a ticket is returned can validate it using the information contained thereon. Although conceivably only the redemption code could be utilized to validate the ticket, prudence dictates employing other information from the ticket to confirm the acceptability of the redemption code and the prize value associated with the ticket if a winner. Such confirmation information may include any or all of the activation code, a machine-readable (e.g. bar) code, a "book" number for the ticket, and a (unique) number pre-assigned to the ticket. Additionally, any or all of the activation code and book and unique ticket numbers may be incorporated into the machine-readable code. In such circumstance a retail clerk, for example, need merely have conventional lottery ticket validation equipment read the machine-readable code and enter into the equipment the redemption code (perhaps also electronically), with the equipment informing the clerk of the winning nature and prize value of the ticket. If desired, further validation or verification information may be included on the ticket, in some cases beneath an opaque removable coating to be removed only by the clerk or other entity validating the ticket.

Embodiments of the invention contemplate only a single validation of a particular ticket. To prevent a player from attempting to have a ticket validated more than once, the validation equipment can, for example, mark the ticket in a manner that prevents further validation attempts or incorporate into its associated memory information concerning the prior validation attempt. The entity validating the ticket can also collect the ticket from the player and not return it after completing the validation process.

Figure 3A:
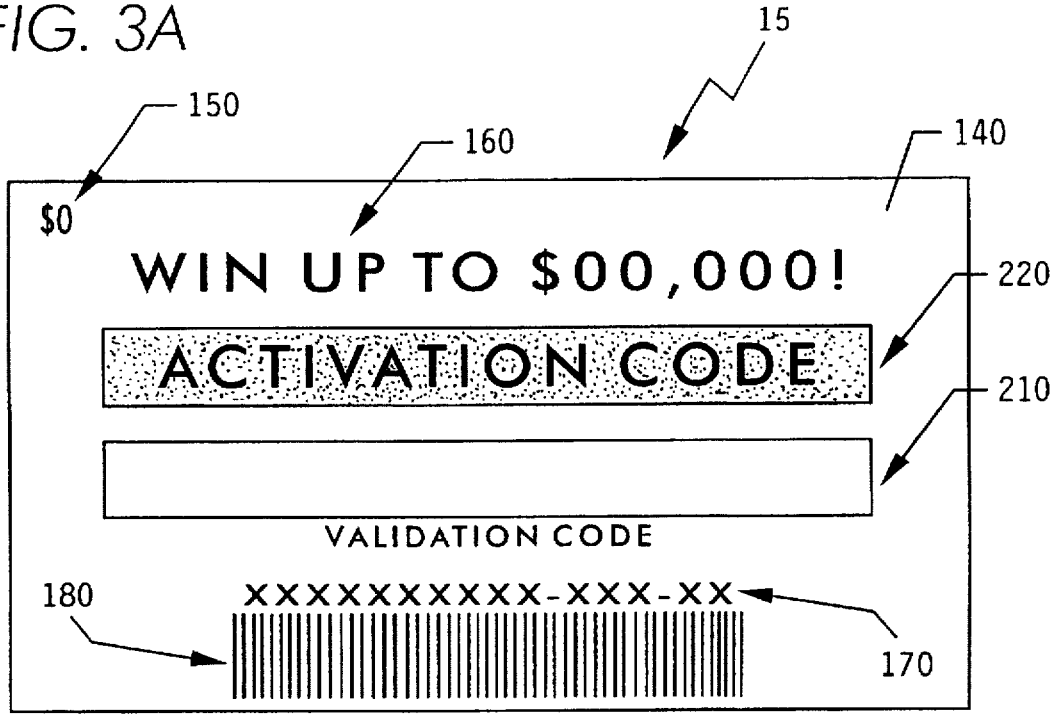
FIG. 3A is a plan view of the face of a ticket usable in connection with the present invention.
Figure 3B:
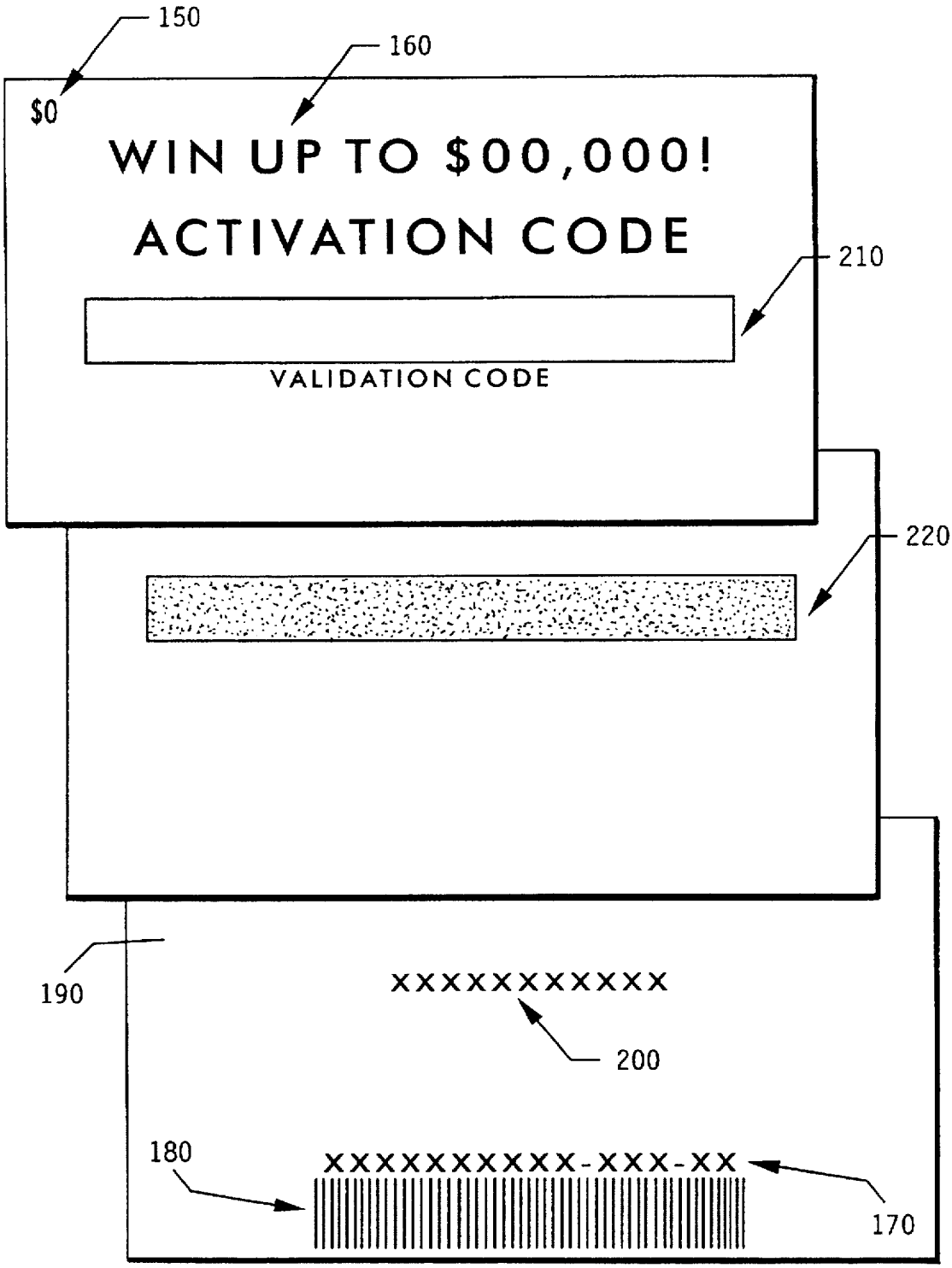
FIG. 3B is an exploded view of the ticket of FIG. 3A.

FIGS. 3A and 3B illustrate an exemplary ticket 15 usable in connection with the present invention. As shown therein, face 140 of the ticket 15 may include such information as purchase price 150, play incentive 160, set 170 of symbols assigned to ticket 15 and to the "book" from which ticket 15 originates, and bar code 180. Any or all of this information may be omitted if necessary or desirable. When present, however, set 170 and bar code 180 may be printed onto substrate 190 much like the hidden indicia or symbols discussed in the Rich, et al. and Brawner, et al. patents. Although not shown in FIGS. 3A and 3B, any of the foundation, contrast, seal, and release coatings disclosed in these patents as well as benday patterns additionally may be employed.

Also included on ticket 15 are activation code 200 and area 210 into which a redemption code may be written. In the embodiment of ticket 15 detailed in FIGS. 3A and 3B, activation code 200 is printed (imaged) onto substrate 190 and covered by an opaque, removable covering 220. When using ticket 15, a player may remove covering 220 to reveal activation code 200 for input into a computer program. After executing the program and receiving a redemption code, the player may write the redemption code in area 210. As so modified, ticket 15 may then be validated if appropriate to determine whether the player is entitled to any award or prize.

Figure 4A:
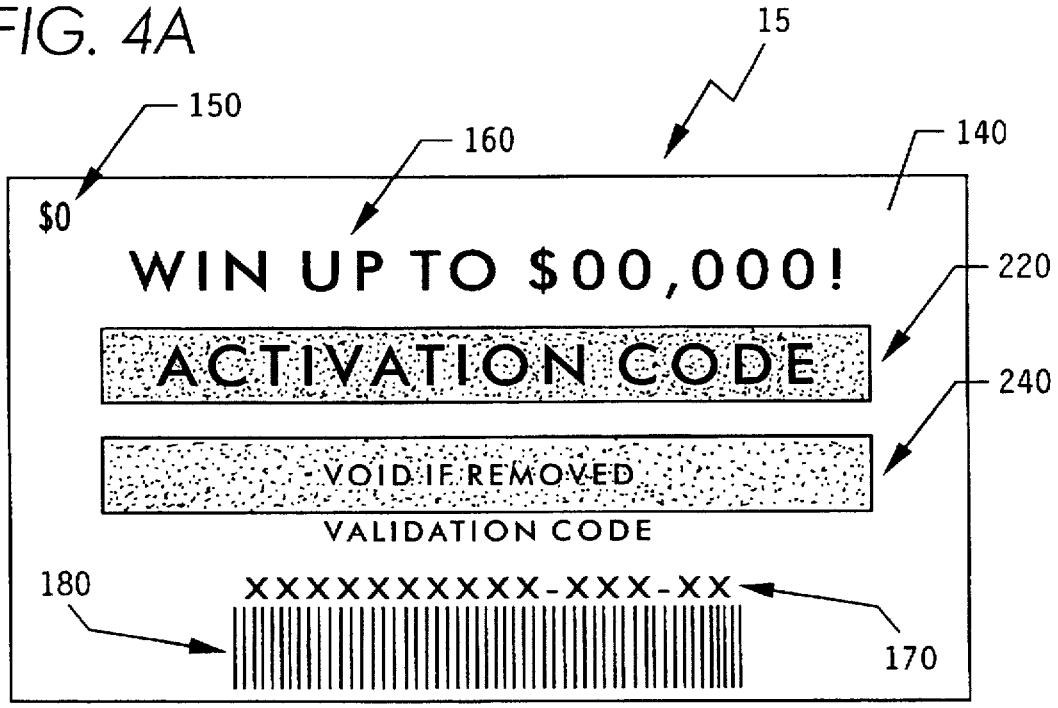
FIG. 4A is a plan view of the face of an alternate ticket usable in connection with the present invention.
Figure 4B:
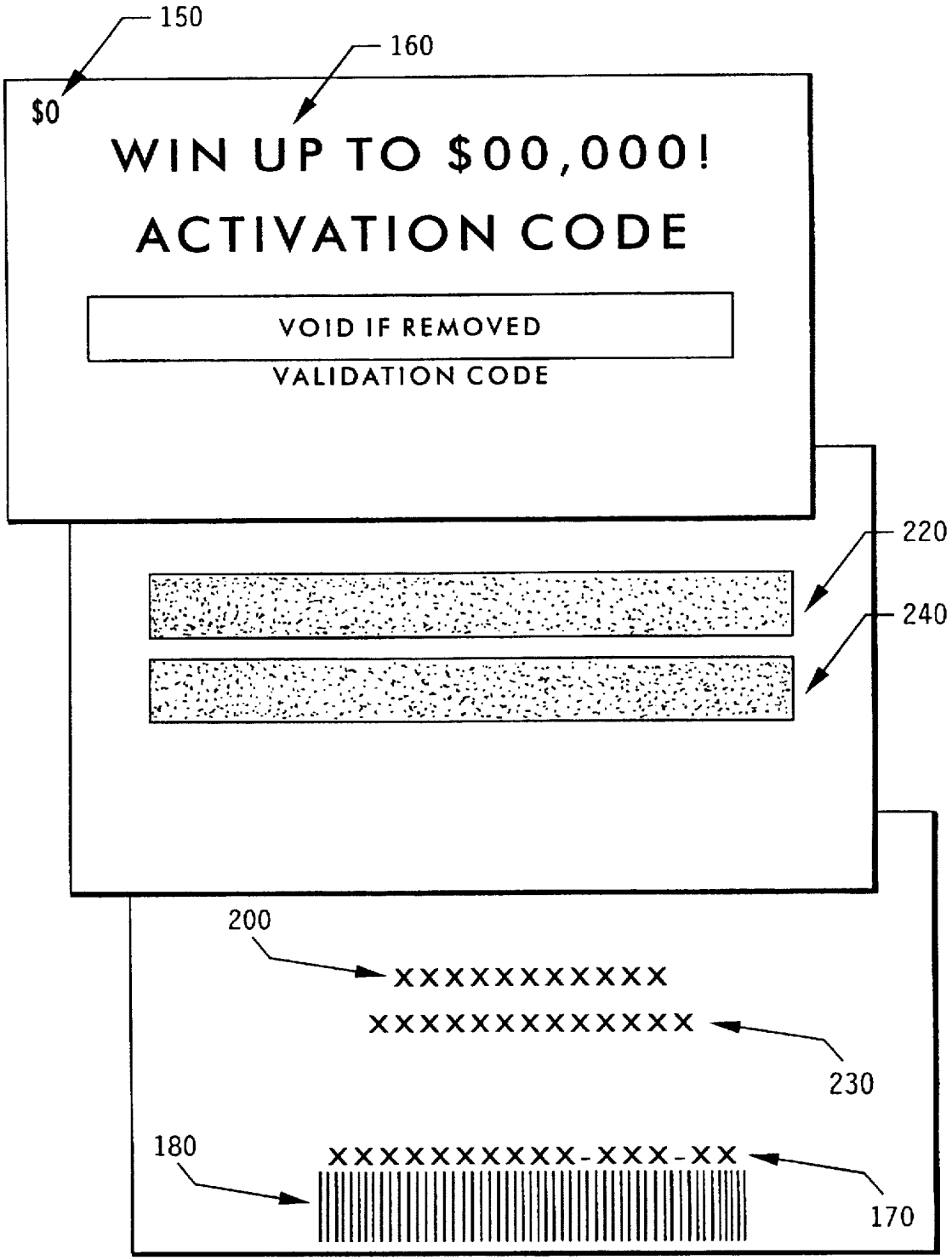
FIG. 4B is an exploded view of the ticket of FIG. 4A.

FIGS. 4A and 4B show a ticket 15 on which redemption code 230 is printed prior to its purchase and use. In such case ticket 15 (without post-play modification) contains information sufficient to permit its redemption whether or not any computer program is executed. After scratch-off covering 240 is removed to reveal redemption code 230, it (together with either or both of set 170 and bar code 180) may be used to determine whether ticket 15 is a "winner." Ticket 15 of FIGS. 4A and 4B nonetheless contemplates a player removing covering 220, inputting activation code 200 into a computer program, and learning through the program whether he or she is entitled to any prize winnings. If so, the player may deliver ticket 15 to a suitable redemption location, where the entity redeeming the ticket 15 removes scratch-off covering 240 to confirm its winning nature. To prevent premature removal of covering 240, a warning such as "VOID IF REMOVED" may be printed thereon.

Figure 5A:
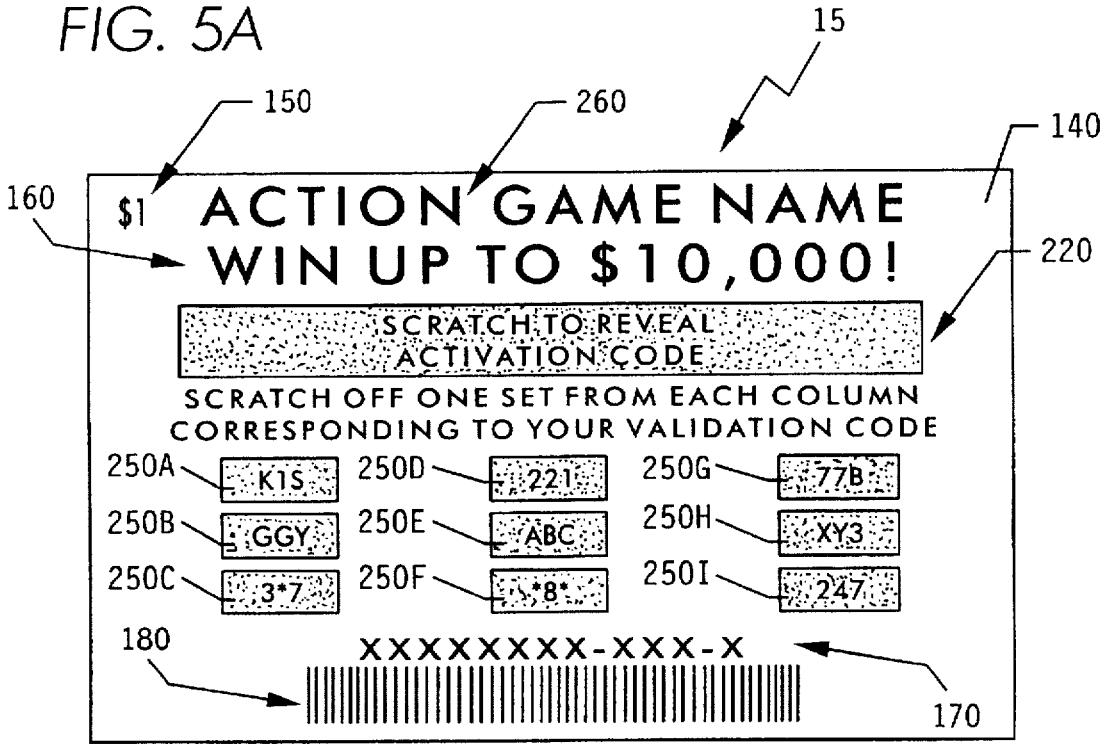
FIG. 5A is a plan view of another alternate ticket usable in connection with the present invention.
Figure 5B:
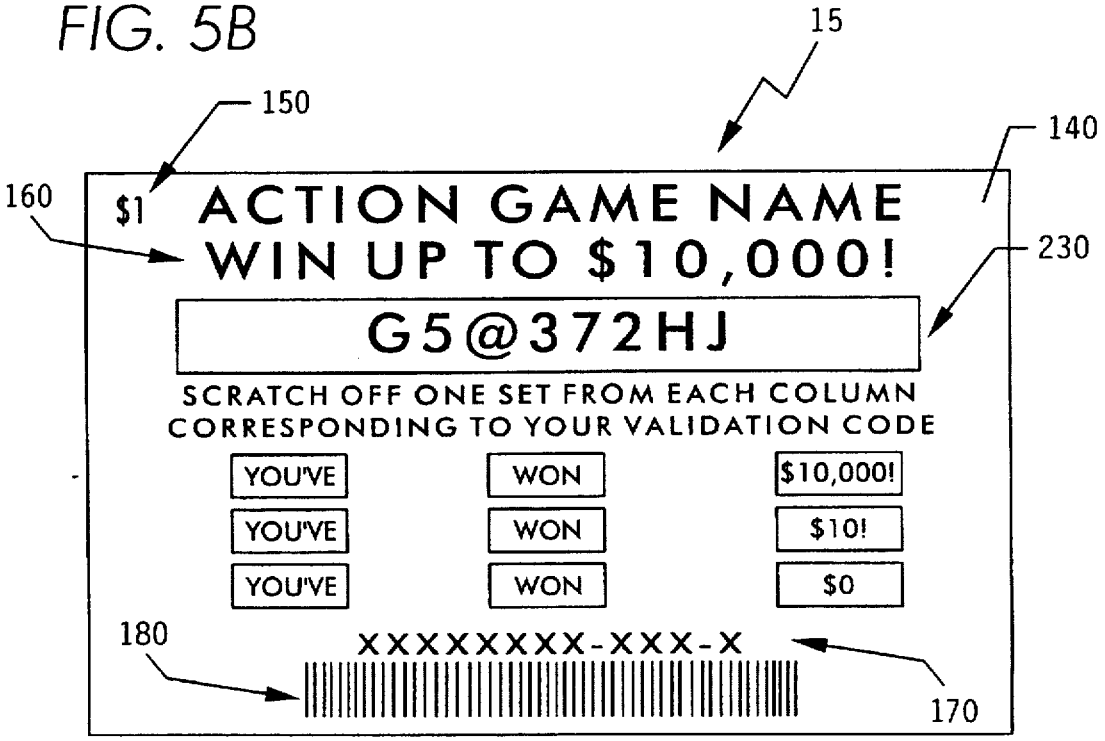
FIG. 5B is a plan view of the ticket of FIG. 5A with the opaque coverings of the ticket having been removed.

Illustrated in FIG. 5A is a version (again exemplary) of ticket 15 in which scratch-off coverings 250A–I are included. Printed atop coverings 250A–I are various symbols 260, at least some of which are components of a legitimate redemption code. After executing a computer program and receiving a redemption code, the player may remove corresponding coverings 250A–I to record the redemption code on ticket 15. For example, if the player's redemption code is 3*7-221-XY3, he or she may reflect the code on ticket 15 by removing coverings 250C, 250D, and 250H. As shown in FIG. 5B (from which ticket 15 all coverings 250A–I have been removed for illustrative purposes), doing so would reveal the award message "YOU'VE WON $10!," informing the player of the amount of the prize won. Of course, those skilled in the art recognize that other messages or information could be revealed instead. In the example of ticket 15 shown in FIG. 5A and 5B, if the redemption code had ended in "77B" the player would have won $10,000, while had it ended in "247" no money would have been awarded. If desired, ticket 15 of FIGS. 5A and 5B additionally may have name 260 linking it to a particular computer program.

The foregoing is provided for purposes of illustrating, explaining, and describing embodiments of the present invention. Further modifications and adaptations to these embodiments will be apparent to those skilled in the art and may be made without departing from the scope or spirit of the invention. Among adaptations suitable in selected circumstances are inclusion of any or all features of the WinWare tickets described above.

What is claimed is:

1. A method of playing a computerized game comprising:

a. obtaining a ticket and an activation code;

b. inputting the activation code into a computer to activate or as part of the computerized game;

c. playing the computerized game;

d. receiving a redemption code as a result of playing the computerized game; and e. modifying the ticket to reflect the redemption code.

2. A method according to claim 1 further comprising redeeming the modified ticket.

3. A method according to claim 2 in which the step of obtaining an activation code comprises examining the ticket and selecting the activation code from information contained thereon.

4. A method according to claim 1 in which the step of modifying the ticket comprises recording on the ticket a set of symbols constituting the redemption code.

5. A method of playing a computerized game comprising:

a. obtaining a ticket;

b. removing from the ticket an opaque covering to reveal an activation codes;

c. inputting the activation code into a computer to activate or as part of the computerized game;

d. playing the computerized game;

e. receiving redemption information as a result of playing the computerized game;

f. modifying the ticket to reflect the redemption information; and g. if appropriate, redeeming the modified ticket.

6. A method according to claim 5 in which the step of modifying the ticket comprises writing the redemption information on the ticket.

7. A method according to claim 5 in which the step of modifying the ticket comprises removing from the ticket at least one covering associated with the redemption information.

8. A method according to claim 5 in which the step of receiving redemption information comprises receiving a set of coded symbols.

9. A method according to claim 5 in which the step of receiving redemption information comprises receiving a prize winnings message.

10. A game-playing system comprising:

a. a ticket on which an activation code is printed;

b. a computer program adapted to receive as input the activation code;

c. means for executing the computer program to provide output information algorithmically linked to the activation code; and d. means for validating the output information; and in which the ticket further comprises:

i. a removable, opaque covering applied over the activation code to obscure it from view; and ii. an area adapted to reflect the output information.

11. A system according to claim 10 in which the ticket comprises machine-readable information unique to it printed thereon.

12. A system according to claim 11 in which the means for validating the output information comprises means for reading the machine-readable information printed on the ticket.

13. A system according to claim 10 in which the area comprises a blank space in which the output information is written.

14. A system according to claim 10 in which the area comprises a removable, opaque covering applied over the output information to obscure it from view.

15. A system according to claim 10 in which the area comprises a plurality of removable coverings, at least one of which corresponds to at least some of the output information.

16. A method of playing a computerized game comprising:

a. obtaining a ticket;

b. removing from the ticket an opaque covering to reveal an activation code;

c. inputting the activation code into a computer to activate or as part of the computerized game;

d. playing the computerized game; and e. receiving redemption information as a result of playing the computerized game.

17. A game-playing system comprising:

a. means for providing an activation code;

b. a computer program adapted to receive as input the activation code;

c. means for executing the computer program to provide output information including a redemption code algorithmically linked to the activation code; and d. means for validating the redemption code.

* * * * *